United States Patent [19]

Sfondrini et al.

[11] Patent Number: 4,597,192

[45] Date of Patent: Jul. 1, 1986

[54] TUNNEL-TYPE APPARATUS FOR CONTINUOUSLY STERILIZING CONTAINERS FOR THE PHARMACEUTICAL INDUSTRY

[75] Inventors: Francesco Sfondrini, Milan; Giancarlo Corelli, Sesto San Giovanni, both of Italy

[73] Assignee: PROT S.r.l., Milan, Italy

[21] Appl. No.: 671,966

[22] Filed: Nov. 16, 1984

[30] Foreign Application Priority Data

Feb. 17, 1984 [IT] Italy ..... 19690 A/84

[51] Int. Cl.[4] ..... F26B 15/18

[52] U.S. Cl. ..... 34/66; 34/105; 34/82; 34/216; 34/225

[58] Field of Search ..... 34/104, 105, 212, 213, 34/216, 66, 82, 225

[56] References Cited

U.S. PATENT DOCUMENTS 3,089,254 5/1963 Johnson et al. ..... 34/105

3,726,020 4/1973 Lee, Jr. ..... 34/105

*Primary Examiner*—Larry I. Schwartz

*Attorney, Agent, or Firm*—Oblon, Fisher, Spivak, McClelland & Maier

[57] ABSTRACT

An apparatus for sterilizing containers such as bottles and vials for the pharmaceutical industry, in the form of a tunnel continuously traversed by a conveyor belt for said containers, comprising a sterlization chamber which utilizes a hot air stream in the laminar flow regime and is provided with air filters, characterized in that in said sterilization chamber the heated air is fed to a pressure chamber communicating in a sealed manner with said filters, and from these latter on to said containers to be sterilized, between said pressure chamber-filter system and walls of the sterilization chamber there being defined a jacket for recirculation of the air, in which the pressure is kept at a lower value than the pressure present in said pressure chamber-filter system.

2 Claims, 2 Drawing Figures

TUNNEL-TYPE APPARATUS FOR CONTINUOUSLY STERILIZING CONTAINERS FOR THE PHARMACEUTICAL INDUSTRY

Apparatus are known in which vials and bottles for the pharmaceutical industry are sterilised by hot air in tunnels continuously traversed by a conveyor belt on which the objects to be sterilised are placed. These tunnels generally comprise in succession at least one preheating station, the hot sterilisation station and a station for cooling the sterilised bottles before their collection. Sterilisation with air heated to 300°-350° C. is mainly effected in the laminar flow regime (in this respect, reference should be made for example to U.S. Pat. No. 3,977,091), and requires a precise system for filtering the hot air before it comes into contact with the objects to be sterilised in the sterile chamber. In this respect, for pharmaceutical applications the degree of sterility of the objects subjected to purification must satisfy very severe standards (Class 100 of U.S. Federal Standard 290/B is applicable).

In sterile chambers of tunnels of known type, a widely encountered problem is the possibility of air seepage from the outside of the filters into the sterilisation environment through any passages which form in the filter gaskets, this tending to occur especially due to wear after a certain time of operation.

The air which seeps from the outside in this manner due to loss of the filter seal is not sufficiently sterile, so that the fact that it can come into contact with the objects to be purified means that these latter undergo a considerable risk of contamination.

The main object of the present invention is to obviate this technical problem. This object and further advantages which will be apparent from the description given hereinafter are attained according to the invention by an apparatus for sterilising containers such as bottles and vials for the pharmaceutical industry, in the form of a tunnel continuously traversed by a conveyor belt for said containers, comprising a sterilisation chamber which utilises a hot air stream in the laminar flow regime and is provided with air filters, characterised in that in said sterilisation chamber the heated air is fed to a pressure chamber communicating in a sealed manner with said filters, and from these latter on to said containers to be sterilised, between said pressure chamber-filter system and walls of the sterilisation chamber there being defined a jacket for recirculation of the air, in which the pressure is kept at a lower value than the pressure present in said pressure chamber-filter system.

The characteristics and advantages of the invention will be more apparent from the description of one non-limiting embodiment thereof given hereinafter with reference to the figures of the accompanying drawings.

Figure 1:
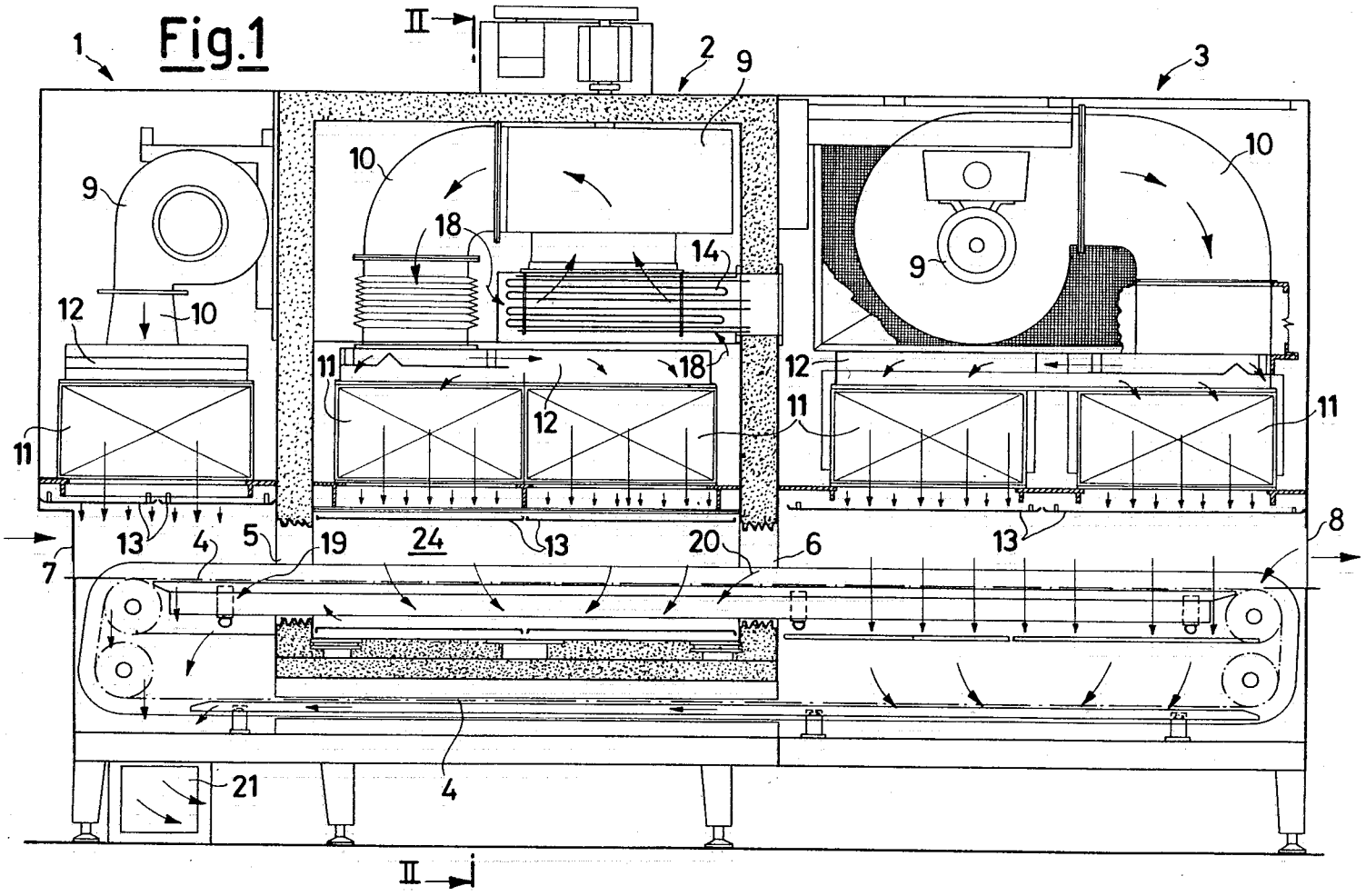
FIG. 1 is a diagrammatic longitudinal cross-section through an apparatus of the invention.

With reference to said figures, an apparatus according to the invention is constituted by a tunnel comprising an inlet and preheating chamber 1, a sterilisation chamber 2, and a cooling chamber 3 which communicate with each other through apertures allowing passage of an endless steel-mesh belt 4 for conveying the objects to be treated. In particular, the chambers 1 and 2 communicate with each other through a passage 5, and the chambers 2 and 3 through a passage 6, these passages being provided with suitable separation baffles, for example of the flap type, which allow the bottles to pass while minimising air transfer from one chamber to the other. The chamber 1 is provided with an inlet 7 for loading the bottles originating from the wash station, and the chamber 3 is provided with a discharge outlet 8, suitably connected to an accumulation device. The chamber 1 is also lowerly provided with a discharge port 21 for the outlet air from the apparatus.

Figure 2:
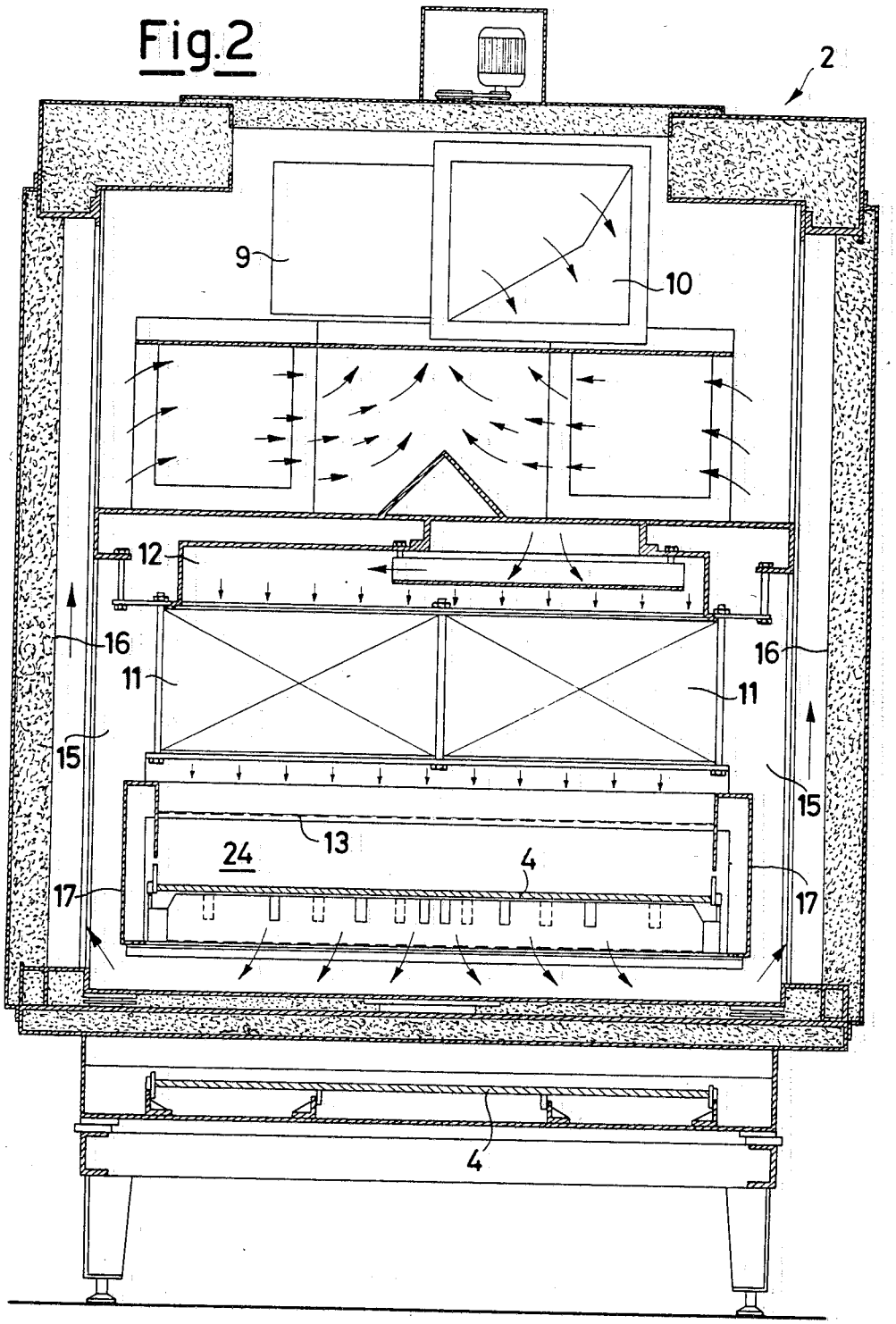
FIG. 2 is a cross-section on the line II—II of FIG. 1.

Each of the three chambers 1, 2 and 3 is provided with a fan 9 which forces the air into an associated air delivery manifold 10 which opens into a filter 11 by way of a pressure or plenum chamber 12. The outlet air from the filters 11 encounters a perforated plate 13 for the production of a laminar flow which finally strikes the objects conveyed by the belt 4. The air circulates in closed cycle through the sterilisation chamber 2. It is withdrawn by the fan 9 and passed through electric resistance heaters 14, then conveyed to the delivery manifold 10. This latter opens into the pressure chamber 12 which communicates in a sealed manner with the filters 11. The air delivery manifold 10, the pressure chamber 12, the filters 11, the perforated plate 13 and the sterilisation space 24 (defined between the plate 13 and the bottle conveyor belt 4) form in the chamber 2 a single body about which an outer jacket 15 (shown in FIG. 2) is defined, bounded by the inner walls 16 of the chamber 2. Below the filters 11, the sterilisation space 24 is bounded by channels 17.

The operation of the apparatus shown in the figures can be summarised as follows, particularly with regard to the innovative part of the invention:

In the sterilisation chamber 2, the air is drawn in at inlet 18 by the fan 9 and passed through the electric resistance heaters 14 by which it undergoes heating.

The heated air is then fed through the manifold 10 and into the pressure chamber 12, from which it is forced against the filters 11. Leaving the filters, it encounters the perforated plate 13, which converts it into a laminar flow sheet, which then strikes the objects conveyed on the belt 4.

The air then passes through the mesh belt 4 and emerges in the outer jacket 15 outside the sterilisation environment. In the outer jacket 15, the pressure is less than that in the sterilisation environment because of the suction produced by the fan 9. The result of this sterile chamber structure is that, as the jacket 15 on the outside of the "plenum chamber-filter-sterilisation environment" assembly is at a lower pressure than this latter, no air seepage is possible from the outer jacket 15 into the sterilisation environment resulting from leakages through the filter gaskets. This ensures that all the hot air striking the bottles has passed through the filters, as absolutely no air can seep from the outside of the plenum chamber-filter system while the pressure difference between the interior and exterior of the sterilisation zone is maintained.

Thus, the air leaving the sterilisation environment through the conveyor belt 4 is again drawn upwards by the suction side of the fan 9, and the air returns through the outer jacket 15 to the electric resistance heaters 14, before being recycled to the filters 11 as sterilisation air, thus completing the closed air cycle in the sterile chamber. From the aforegoing description, it is apparent that contact between unfiltered air and the bottles is prevented, whereas, should there be any air seepage due to sealing deficiency at the filter gaskets, this would be sterile air drawn from the zone below the filters and seeping outwards into the lateral zones, to again reach the fans 9 to be then newly fed to the filter level.

A further advantage of the jacket 15 outside the sterilisation environment as provided by the invention is that drawing the air in from the side channels of the sterile chamber leads to greater uniformity of air mixing and a minimising of temperature gradients in the system. The fans 9 in the three component chambers of the tunnel according to the invention operate under such conditions as to maintain the pressure in any chamber greater than the pressure in the preceding chamber, starting from the inlet chamber and progressing to the cooling chamber. This condition results in minimum air seepage through the passage apertures for the conveyor belt 4 in the directions shown in the figures by the arrows 19 (of the passage 5) and 20 (of the passage 6). As the pressure in the preheating chamber 1 is lower than in the sterilisation chamber 2, a minimum quantity of hot air is drawn through the passage 5 into the preheating chamber 1. This air thus preheats the bottles in the inlet chamber, while at the same time producing an air change in the sterilisation chamber 2 so as to favour total elimination of the residual water contained in the bottles in the preheating chamber 1. As the pressure in the cooling chamber 3 is greater than in the sterilisation chamber 2, a quantity of air equal to the leaving air enters the sterilisation chamber 2 through the passage 6.

Generally, it can be said that, according to the invention, the air circulation through the tunnel, rather than being in the form of true laminar flow, is instead in the form of slightly turbulent flow, but of carefully controlled regime. It has been found experimentally that the uniformity obtained by the apparatus according to the invention is very satisfactory both with regard to air temperature and with regard to air velocity, so that in practice no differential heating of the containers occurs across the width of the belt. Because of the uniform flow of the containers, the passage of heat over their surface and the consequent temperature rise are also very uniform. No considerable thermal stresses therefore arise in the container walls.

We claim:

1. Apparatus for sterilising articles, said apparatus comprising:

(a) a sterilisation space having lateral walls, an inlet, and an outlet;

(b) a mesh conveyor belt which passes through said sterilisation space via its inlet and its outlet and which, during use of the apparatus, conveys the articles to be sterilised through said sterilisation space;

(c) an airtight outer jacket laterally surrounding said sterilisation space, said airtight outer jacket being in fluid communication with said sterilisation space between said mesh conveyor belt;

(d) a fan having an inlet and an outlet, the inlet of said fan being in fluid communication with said airtight outer jacket, thereby maintaining a lower pressure in said airtight outer jacket than is present in said sterilisation chamber during use of the apparatus, and the outlet of said fan being in airtight fluid communication with an airtight fluid conduit leading to said sterilisation space above said mesh conveyor belt, said airtight fluid conduit being entirely contained within said airtight outer jacket;

(e) means for heating air forced through said sterilisation space by said fan to sterilisation temperatures, said means being located upstream of said fan;

(f) a filter located in said airtight fluid conduit, said filter being sized, shaped, and positioned to filter all the air forced through said airtight fluid conduit by said fan; and (g) a perforated plate located in said airtight fluid conduit, said perforated plate being sized, shaped, and positioned to produce a laminar flow of the air forced through said airtight fluid conduit by said fan which passes over the articles to be sterilised, through said mesh conveyor belt, and into said airtight outer jacket, whereby, if a leak occurs in said airtight fluid conduit, the air will flow from the airtight fluid conduit into said airtight outer jacket rather than vice versa.

2. Apparatus as recited in claim 1 and further comprising:

(a) a preheating chamber located upstream of said sterilisation space, said preheating chamber being sized, shaped, and positioned so that said mesh conveyor belt passes through said preheating chamber before it passes through said sterilization space;

(b) a cooling chamber located downstream of said sterilisation space, said cooling chamber being sized, shaped, and positioned so that said mesh conveyor belt passes through said cooling chamber after it passes through said sterilisation space;

(c) means for maintaining the pressure in said preheating chamber lower than the pressure in said sterilisation space during use of the apparatus; and (d) means for maintaining the pressure in said cooling chamber higher than the pressure in said sterilisation space during one of the apparatus.

* * * * *